United States Patent [19]

Tsukamoto

[11] Patent Number: 4,920,614

[45] Date of Patent: May 1, 1990

[54] CLAMPING DEVICE

[76] Inventor: Tatusabu Tsukamoto, No. 2570 Ohaza Mukaizima, Chiyodamachi, Kanzakigun, Saga 842, Japan, 842

[21] Appl. No.: 344,421

[22] Filed: Apr. 26, 1989

Related U.S. Application Data

[63] Continuation of Ser. No. 205,059, Jun. 3, 1988, abandoned, which is a continuation of Ser. No. 883,466, Jul. 11, 1986, abandoned, which is a continuation of Ser. No. 755,555, Jul. 16, 1985, abandoned, which is a continuation of Ser. No. 548,860, Sep. 23, 1983, abandoned.

[30] Foreign Application Priority Data

Jan. 23, 1982 [JP] Japan ..... 57-9204

[51] Int. Cl.[5] ..... B42F 1/04

[52] U.S. Cl. ..... 24/67.5; 24/67 R; 24/515; 24/537

[58] Field of Search ..... 24/67 R, 67.3, 67.5, 24/67.9, 537, 568, 503, 513, 524, 535, 536, 517, 505, 502, 515, 542, 17 R, 489, 552, 546, 555

[56] References Cited

U.S. PATENT DOCUMENTS

| | | | |
|---|---|---|---|
| 51,520 | 12/1865 | Riggs | 24/67 R |
| 60,627 | 12/1866 | Goble | 24/515 |
| 134,756 | 1/1873 | Marston | 24/537 X |
| 292,581 | 1/1884 | Poor et al. | 24/537 |
| 520,053 | 5/1894 | Hopkins | 24/537 X |
| 692,274 | 2/1902 | Gumaer | 24/537 |
| 810,729 | 1/1906 | Deane | 24/537 X |
| 848,584 | 3/1907 | Albin et al. | 24/537 |
| 890,541 | 6/1908 | Van Buren | 24/67 R |
| 1,179,656 | 4/1916 | Rosenstern | 24/552 |
| 1,838,410 | 12/1931 | Kitts et al. | 24/517 X |
| 2,187,579 | 1/1940 | Van Knopke | 24/542 X |
| 2,838,817 | 6/1958 | Wills | 24/67.9 |
| 3,744,686 | 7/1973 | Levitin | 24/535 X |
| 4,238,865 | 12/1980 | Ingelmann et al. | 24/537 X |
| 4,308,981 | 1/1982 | Miura | 24/537 X |

FOREIGN PATENT DOCUMENTS

| | | | |
|---|---|---|---|
| 441450 | 3/1925 | Fed. Rep. of Germany | 24/537 |
| 13264 | 3/1911 | France | 24/503 |
| 663761 | 8/1929 | France | 24/67.9 |
| 14-18731 | 9/1925 | Japan . | |
| 35-22801 | 9/1960 | Japan . | |

*Primary Examiner*—James R. Brittain

[57] ABSTRACT

A clamping device which has clamping units including a pair of openable arms extending in a V-shape toward one side of a pivotal center and in a X-shape toward both sides thereof, and a pair of retainers projecting from the ends of each of the arms a predetermined length toward the end, and a clamping means slidably engaged with parts of the arms of said clamping units for adjusting and holding the amount of closing of the arms in response to the thickness of an article to be clamped. The article is clamped and held by the force of restoration produced by the deformation of the clamping units occurring when the article is inserted between the pair of retainers and the pair of arms are closed.

3 Claims, 3 Drawing Sheets

CLAMPING DEVICE

This application is a continuation of application Ser. No. 07/205,059, filed June 3, 1988 abandoned, which is a continuation of Ser. No. 883,466 filed July 11, 1986, abandoned, which is a continuation of Ser. No. 755,555 filed July 16, 1985, abandoned, which is a continuation of Ser. No. 548,860 filed Sept. 23, 1983 (abandoned).

FIELD OF THE INVENTION

The present invention relates to a clamping device which can quickly clamp/unclamp thick packages of loose sheets of paper or pamphlets.

BACKGROUND OF THE INVENTION

A prior art wire device includes a piece of wire wound one and a half times on one plane in a rectangle to form two legs which define the longitudinal sides thereof. Such a paper clip is defective, however, as a device for firmly clamping things of a certain thickness without displacement. More particularly, when bulky sheets of paper are inserted between the legs, the tips of these legs come off of the surface of the paper, thereby leaving the clamping force concentrated on the edge of the paper. The loose legs easily catch other articles and the clip itself may slip off the paper bundle and the turned-up legs present difficulties when the clipped sheets of paper have to be stacked in pile. Further, the stress concentrates on the narrow part at the root of the legs, exceeding the elastic limit of the wire. The paper clip of this type clamps sheets of paper with its long legs substantially normal to the edge of the sheets but not parallel thereto. When one skims through the content of the paper sheets clamped with the clip by turning the pages, the tips of the leg get in the way and make it difficult to fully open the page. If, on the other hand, the page is forced open, the clip may slip off. Thus, the paper clip of this type is fundamentally defective as a device for clamping thick bundle of sheets.

A so-called double-clip which is a clamping metal made of hard steel plate having a predetermined width, formed as an isosceles triangle in cross section and provided with a lever for opening the mouth of the clip.

Said double clip is limited in the package thickness it can accommodate by the height of the back member which is the base of the isosceles triangle, and therefore it can only be used to clamp articles thinner than the height of the height dimension of the back member. In most cases, the back of the clamping metal protrudes perpendicularly from the surface of the article at the edge thereof. This protrusion causes various inconveniences when the articles are stacked.

Further, when one goes through the papers by turning the pages, said lever may get in the way. Because of its construction, said double clip is more costly to manufacture and is thus considerably more expensive than other clamping devices.

In view of the defects found in the conventional clamping devices, the present invention aims to provide a novel clamping device which fulfills the requirements such that: it can firmly clamp thick articles such as sheets of paper; the clamping member may snugly attach to the both surfaces of the article at its edge; it can clamp an article with its clamping arms extending close to the edge so that the pages can be fully turned open to the extreme edge; the clamping means will not twist or damage the paper in use; the construction is simple enough to be manufactured at low cost.

SUMMARY OF THE INVENTION

The clamping device according to the present invention comprises a clamping unit including a pair of arms extending symmetrically from a pivotal center in at least one side direction in the form of the letter V, a pair of clamping edges extruding from the ends of respective arms toward each other and a guiding means provided inside the arms, and a clamp means provided slidably within said arms. The clamping device is characterized in that when an article is clamped between said pair of clamping edges, said pair of arms are maintained suitably close to each other by a clamp means, thereby clamping the article in place by restoring force caused by deforming the clamping unit.

According to the present invention, the clamping body has sufficient resilience so that by suitably positioning the clamping means, the arms can always be maintained with the optimum degree of closing depending on the thickness of the article to be clamped.

The clamping force can be concentrated on the tips which are located suitably inward from the edge of the article. Moreover, the clamping edges are made symmetrical and are capable of retaining the article from both surfaces thereof at a normal angle.

As a consequence, the clamped portion of the article will not be twisted or damaged, thereby attaining smooth and aligned clipping. The device as a whole produces firm and secure clamping.

The clamping unit according to the present invention can be made from resilient material either in wire or plate form. As a clamping body made of wire can deform as a whole, its force of restoration can be used as the clamping force. The clamping device made of wire is preferred because of its high resilience and high clamping force.

Other features, objects and effects of the present invention will become apparent from the description of the preferred embodiments.

DESCRIPTION OF A PREFERRED EMBODIMENT

Referring to FIGS. 1–4, a clamping device 20 comprises a clamping body 21 which is made by bending a piece of elastic wire and a clamping plate 22 which is slidably mounted on a pair of arms 1*a* and 1*b* of said clamping body 21.

Figure 1:
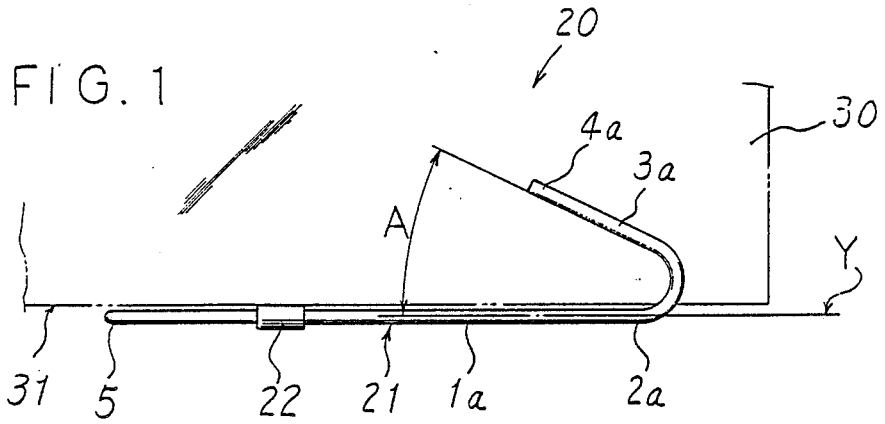
FIG. 1 is a plan view of a clamping device according to one embodiment of the present invention.
Figure 2:
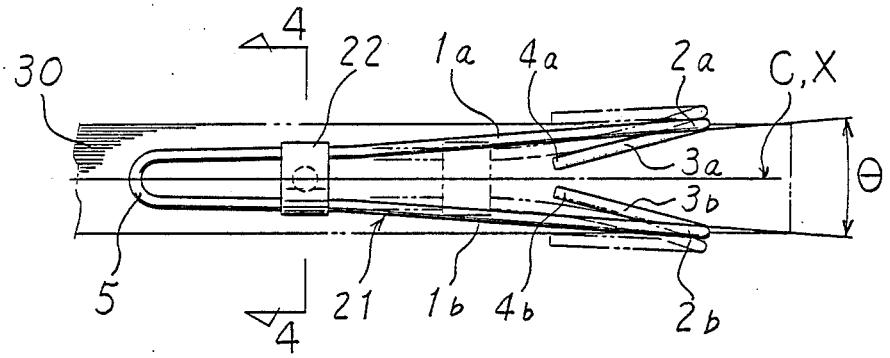
FIG. 2 shows the clamping device of FIG. 1 in the rear view.
Figure 4:
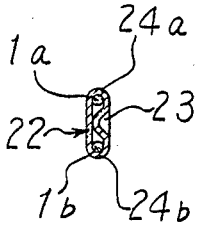
FIG. 4 shows a sectional view of FIG. 1 along the line 4—4.
Figure 3:
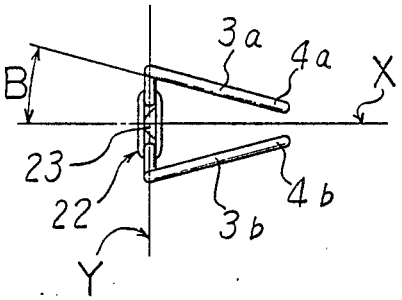
FIG. 3 is a side view of the clamping device shown in FIG. 1 when viewed from the right.

The clamping body 21 is made of a wire material bent at a small radius to form a V-shape and comprises a pair of arms 1*a* and 1*b*, and a pair of press members 3*a* and 3*b* which extend from the ends 2*a* and 2*b* of said arms toward the article to be clamped (toward the clamping position), and are symmetrically bent inward to oppose each other. The pair of arms 1*a* and 1*b* extend for a predetermined length with a very slight inclination, or almost in parallel, toward the center 5 of the body. Said arms 1*a* and 1*b* are curved toward the ends 2*a* and 2*b* so that they can be opened at a fairly steep angle $\theta$. The pair of press members 3*a* and 3*b* are bent at a sharp angle A as measured from the arms 1*a* and 1*b* respectively. As is evident from FIG. 3 which shows the press members when viewed from the side at the end of the arms, the press members are inclined at the tips form with 4*a* and 4*b* thereof so that the tips each other an angle B with respect to a plane X which is on the center line C and perpendicular to the plane Y. Thus, the interval between the tips 4*a* and 4*b* of the press member is much smaller than the interval between the ends 2*a* and 2*b* of the arms. The clamping body of this construction is therefore made flexible as the pair of arms 1*a* and 1*b* thereof are openable/closable on the plane Y with a bight section, or center 5 as the pivotal center. In this embodiment, the pair of arms 1*a* and 1*b* function as a sliding guide for the clamping plate 22. The clamping plate 22 which bridges the arms has a ring-like shape and is made of a thin strip of iron and the sides 24*a* and 24*b* are bent to have inner width which corresponds with the width of the center 5 of the arms at the outer periphery thereof for catching the arms. The clamping plate 22 is slidable on the pair of arms in the longitudinal direction. An inner projection 23 is provided at the center of the clamping plate 22, projecting between the arms to prevent the plate from slipping out from the center 5. As the clamping plate 22 is moved toward the end of the arms, it closes the arms in opposition to the bias caused by the deformation at the clamping body. A force parallelogram can be drawn from the catching edges, 24*a* and 24*b* and the outer periphery of the arms. FIGS. 1 and 2 illustrate the clamping device in clamping operation by the line of two-dots and dash. As shown in the drawing, the tips 4*a* and 4*b* of the press members 3*a* and 3*b* are fully opened to become almost parallel to each other and firmly clamp a thick bundle of paper sheets 30 from both surfaces thereof. The clamping plate 22 is moved more than half the length of the arms 1*a* and 1*b* to a position near the ends 2*a* and 2*b* to thereby increase the curve of the arms at the ends thereof. The arms of the innerside thereof closely abut against the ridge 31 of the paper sheets, with hardly any projection. In the clamping device 20 during clamping operation, a complicated load due to twisting and bending is applied on the arms extending from the bent portion of the press members 3*a* and 3*b* to the center 5 of the arms. The clamping body 21 with the pair of long arms has sufficient flexibility the deformation on the press members clamping position to result in a firm in a clamping force. Thus, a clamping device which has excellent stress distribution and which is unlikely to have permanent set can be obtained. Moreover, the clamping device 20 is simple in structure and easy to handle as the arms are openable by merely moving the clamping plate.

The degree of opening $\theta$ of the arms naturally varies in correspondence with the thickness of the papers to be clamped. By sharply angling the press members with respect to the arms at an angle A as shown, it is possible to increase the amount of displacement, i.e. clamping force, in proportion to the increased thickness of the papers to be clamped. With an acute angle A such as shown in the drawing, the line of contact between the press members and both surfaces of the paper will be substantially in parallel with the ridge 31 of the paper. This produces a desirable effect that the clamping device becomes less likely to slip from the ridge. Thus, the angles A and B are of significance in forming the press members as they play an important role in increasing the clamping force of the press members and thus in providing an for the device excellent clamping function.

Figure 5:
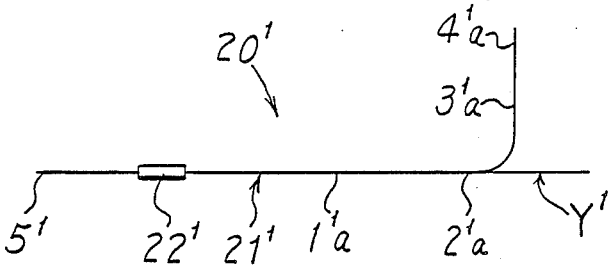
FIG. 5 is a plan view of another embodiment of the clamping device according to the present invention.
Figure 6:
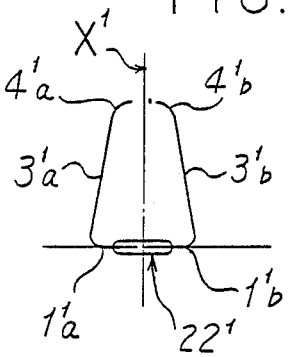
FIG. 6 shows a side view of the clamping device of FIG. 5 when viewed from the right.

Referring now to FIGS. 5 and 6, another embodiment of the press member is shown. In the description below, identical parts or parts which have identical functions to the foregoing embodiment are given the same reference numbers affixed with a supplementary number as $3^1$, $3^2$, $3^3$, . . . and additional parts are given new reference numbers. To avoid redundancy, the new embodiment will be described mainly in its new aspects.

The press member $3^1a$ and $3^1b$ are bent inward at a normal angle with respect to the arms $1^1a$ and $1^1b$ with their respective tips $4^1a$ and $4^1b$ closing symmetrically with the plane $X^1$. In this embodiment during clamping operation, the force of restoration at the arms due to twisting mainly acts as the clamping force at the press members.

In order for the press members to firmly contact both surfaces of the article to be clamped in a wide range of thickness in a desirable manner as well as with sufficient clamping force, it is necessary to allow provide a sufficient range of elastic deformation to the press members as well as a sufficient spring constant under the restrictions of a given material and of configuration. The clamping device according to the present invention made of elastic wire material allows the press members to be deformed to the fullest extent by the clamping means at the tip of the press members as mentioned above. In other words, the clamping force is produced by the force of restoration caused by the overall deformation of the clamping body with the clamping plate as the fulcrum. In the clamping device 20, the clamping body 21 may not necessarily be made by bending one piece of wire material. It is possible to obtain the body by firmly bonding two pieces of wire material at a position on one side of the pivotal center as by welding or other methods.

In order to achieve the most preferred clamping with the device according to the present invention, the clamping means should be able to give sufficient deformation to the press members necessary for clamping even a relatively thin article, and at the same time, it should be able to stay as close to the ends of the arms as possible for securely clamping a thick article.

Figure 7:
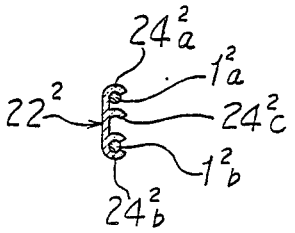
FIG. 7 shows a vertical sectional view of the clamping means of a clamping device according to still another embodiment of the present invention.

Thus, the articles to be clamped would naturally be limited in thickness when one attempts to clamp using one clamping plate as mentioned above which has catching edges of a fixed width. FIG. 7 shows an embodiment which is capable of clamping articles having a wider range of thickness in a desirable manner with one clamping plate.

The clamping plate $22^2$ is made of suitable material such as plastics comprises a base edge $24^2b$, an outer arm-catching edge $24^2a$ and an inner arm-catching edge $24^2c$ interposed between said edges $24^2a$ and $24^2b$. The base edge $24^2b$ is firmly but slidably attached to one of the arms $1^2b$. The outer arm catching edge $24^2a$ and the inner arm catching edge $24^2c$ open outwardly at their inner sides and are detachably engaged to the other arm $1^2a$. For clamping a thin article, the arm $1^2a$ is attached to the inner arm-catching edge $24^2c$; for thicker articles, the arm $1^2a$ is attached to the outer arm-catching edge $24^2a$ as shown. By thus suitably adjusting the amount of opening of the arms, desirable clamping can be obtained.

According to the present invention, it is possible to provide the clamping bodies on both sides of the pivotal center. This arrangement also offers various advantages.

Figure 8:
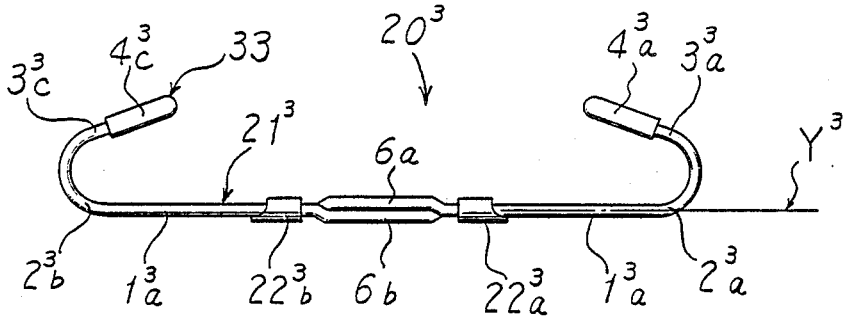
FIG. 8 shows still another embodiment of the present invention in a plan view.
Figure 9:
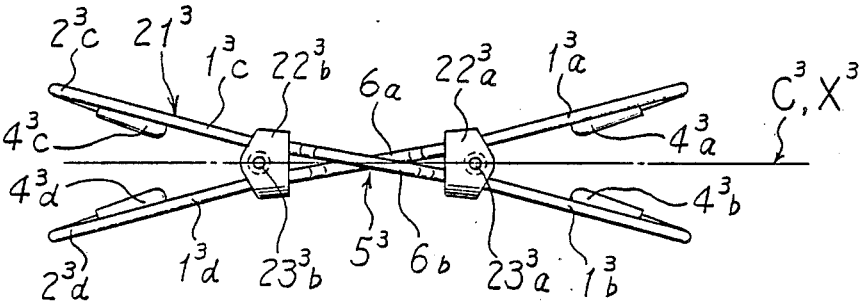
FIG. 9 is a rear view of the clamping device shown in FIG. 8.

The device shown in FIGS. 8 and 9 embodies this arrangement in a preferred manner. The clamping device $20^3$ comprises a clamping unit $21^3$ which is made of two pieces of elastic wire material intersecting to form an X-shape, and two pieces of clamping plates $22^3a$ and $22^3b$ mounted on the arms on both sides of the junction $5^3$, or the pivotal center. At the center where the two members intersect, is provided respectively with a recess 6*a* and 6*b* having a predetermined length. On both sides of the junction $5^3$ are pairs of arms $1^3a$ and $1^3b$, $1^3c$ and $1^3d$ and pairs of press members $3^3a$ and $3^3b$ and $3^3c$ and $3^3d$ substantially identical in shape with said clamping device 20. By intersecting two pieces of wire material having the recesses 6*a* and 6*b*, the arms on both sides can be positioned on the plane $Y^3$. As the recesses 6*a* and 6*b* engage with each other, relative displacement of the two members in the axial direction can be prevented. The clamping plates $22^3$ and $22^3$ are made of thin thin strip of iron in the shape identical with the clamping plate $22^2$ of the foregoing embodiment. The inner projections $23^3a$ and $23^3b$ are useful in opening the arms on both sides of the pivotal center. In other words, by moving the clamping plates $22^3a$ and $22^3b$ toward the pivotal center, said pairs of arms can be opened to an extent necessary for clamping. For clamping an article with the clamping device $20^3$, the arms on both sides are opened to insert the article between the press members provided at the respective tips thereof. Then, one of the clamping plates is moved to close the arms on its side before closing the arms on the other side by moving the other clamping plate. Deformation occurring at the arms on both sides of the pivotal center and at the press members is almost the same as in the clamping device 20. The clamping device $20^3$ is well-balanced as the two intersecting members of the clamping unit are twisted in the opposite directions at their tips. Here again, the clamping force is given by the restoring force of the clamping unit with the clamping plates serving as the fulcrums when the overall unit is deformed. When clamping a pile of papers at one point, a clamping device is usually very vulnerable to rotational force on the paper along the direction of the plane $X^3$ even if the device has sufficient clamping force. The embodiment being described here is advantageous over the foregoing two embodiments in that, as it clamps an article firmly at two spaced apart positions, the pile of papers can be held in place with less tendency to cause rotational displacement. This in turn gives the device better pressing force. As other conceivable embodiments having clamping unit provided on both sides of the pivotal center, the clamping units may be securely bonded by means of welding or a band; or two pieces of said clamping device 20 may be bonded at the center with the tips having the press members facing opposite directions. As shown in FIGS. 8 and 9, a rubber cap 33 which is effective in preventing slipping may be attached on the press members. The press members can be formed with impressions to give a coarse surface or formed flat. There are other ways known in the art to prevent slipping such as providing spiky projections.

Figure 10:
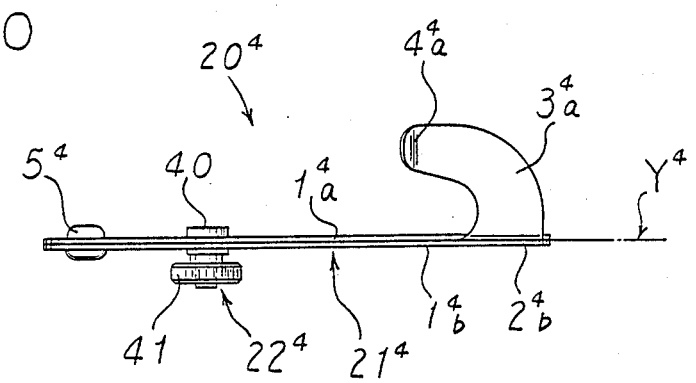
FIG. 10 is a plan view showing still another embodiment of a clamping device.
Figure 11:
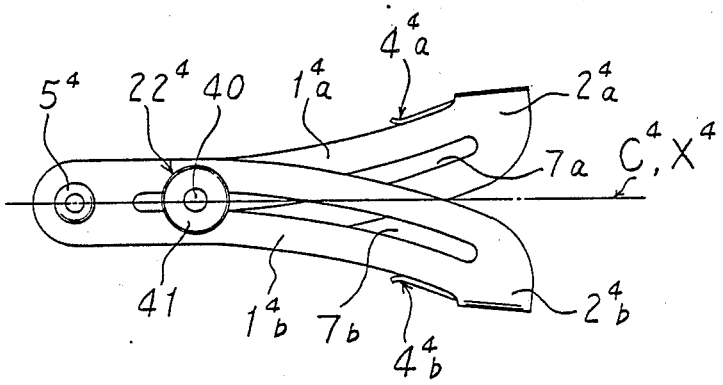
FIG. 11 is the rear view of the clamping device shown in FIG. 10.
Figure 12:
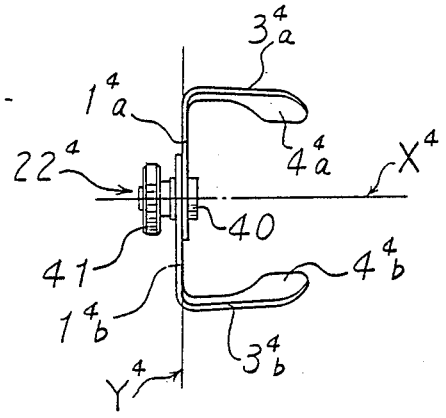
FIG. 12 is the side vidw of the clamping device of FIG. 10 when viewed from the right.

Instead of the elastic wire material, the present invention can be embodied using a plate material. The embodiment shown in FIGS. 10 and 11 is made of a plate material. The clamping device $20^4$ comprises clamping member 24 made of thin elastic plate and molded to curve outwardly so that when assembled, the members are symmetric. The members are overlapped at the respective bases and connected by means of a pin $5^4$. The arms $1^4a$ and $1^4b$ are openable with the pin $5^4$ as the pivotal center. The ends $2^4a$ and $2^4b$ of the arms are bent outwardly to project in the direction of the clamping side and provided with a pair of press members $3^4a$ and $3^4b$ that are symmetric with respect to the plane $X^4$.

Said press members $3^4a$ and $3^4b$ are substantially smaller than the pair of arms $1^4a$ and $1^4b$ in width, extend for a predetermined length from the outer ends of the arms and further extend in parallel with the arms for a predetermined length toward the pin. The press members $3^4a$ and $3^4b$ are further inclined so that the tips $4^4a$ and $4^4b$ thereof can close with each other toward the plane $X^4$ in a symmetrical manner. The press members themselves are flexible in the clamping direction.

Elongated holes $7^4a$ and $7^4b$ are provided in the arms in order to open/close and fix the arms in place by a screw clamping means $22^4$ which is inserted in said holes. That is, inside each arm $1^4a$ and $1^4b$ are defined elongated holes $7^4a$ and $7^4b$ which extend along the curvature of the arms. The screw shaft 40 of the screw clamping means is inserted through the hole $7^4a$ of the arm which comes in contact with the article to the hole $7^4b$ of the other arm. At the back of said screw shaft 40 is a clamp screw 41 which firmly clamps the arms $1^4a$ and $1^4b$ at a desired of opening. The arms are openable by loosening the screw clamping device $22^4$ and by sliding the same within the holes $7^4a$ and $7^4b$.

When in clamping operation, deformation takes place mainly at the press members $3^4a$ and $3^4b$ to cause the same to come in close contact with the surfaces of the article, and elastic restoration force occurring at such portions will give rise to the clamping force of the device. As the clamping members are made of thin plate, they can be snugly contacted against both surfaces of the article and can effect smooth clamping. Since the screw means are used to firmly fix the arms in close contact with the surfaces of the article, the twisting and slipping of the arms can be prevented and the tendency of the press members to expand at the tip can also be restricted. In a clamping device made of rigid plate material, flexibility of the press members is a critical factor. It is possible to use plastics and like material for the arms, and the press members which are to be embeded or otherwise bonded to the tips of said arms can be made of highly elastic steel plate.

Various modifications can be made with the clamping means as the present invention will not be effected by the type or shape of the clamping means. Various modifications are possible with the means for preventing the clamping means from slipping. For example, the surface of the arms can be provided with impressions such as teeth to engage with the detachable catching means provided on the clamping plate. Or, highly frictional material such as rubber can be attached to the arms so that the clamping plates can be prevented from slipping.

As has been described above, the clamping device according to the present invention is capable of adjusting the degree of opening of arms depending on the thickness of the articles so that relatively thick articles can be clamped smoothly. The device is particularly advantageous as it clamps the article firmly at a normal angle at a position well inside from the edge of the paper.

What is claimed is:

1. A clamping device for clamping together sheets of paper, comprising:

(A) a clamping body formed of elastic wire and consisting of:

(1) a pair of arms formed by sections of said wire, and a bight section connecting said arms at proximal ends thereof to form substantially a V-shape in a first plane; said arms being biased apart to diverge from said bight section to define an angle of opening in said first plane; said arms being movable in opposite directions in said first plane towards and away from each other;

(2) a pair of press members formed by sections of said wire and respectively integrally formed on distal ends of said arms; said press members being disposed on either side of a second plane which is perpendicular to said first plane and bisects said angle of opening, wherein each said press member forms an acute angle with the first plane and said arm to which said press member is attached, said press members having free ends which are disposed closer to the said second plane than the distal ends of said press members, said free ends making an acute angle with said second plane greater than half said angle of opening; and (B) a single clamping plate slidably mounted on said arms and having engaging sections forming at least two channels for receiving said arms; said two channels being spaced apart a distance which is less than the spacing between said distal ends of said arms whereby said arms are forced together as said clamping plate is moved from said bight section towards said distal ends so that said press members engage and clamp together sheets of paper placed between said press members.

2. A clamping device as claimed in claim 1, wherein said clamping plate has another channel between said two channels, one of said two channels being connected to but slidable with respect to one of said arms, the other two channels being adapted to selectively receive the other one of said arms for varying the spacing between said arms.

3. A clamping device according to claim 1, wherein said wire is a single integral wire.

* * * * *